US008215749B2

(12) United States Patent
Komura

(10) Patent No.: US 8,215,749 B2
(45) Date of Patent: Jul. 10, 2012

(54) LIQUID DROPLET DISCHARGE APPARATUS

(75) Inventor: Tatsumi Komura, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 406 days.

(21) Appl. No.: 12/069,315

(22) Filed: Feb. 8, 2008

(65) Prior Publication Data

US 2008/0211867 A1 Sep. 4, 2008

Related U.S. Application Data

(62) Division of application No. 11/226,765, filed on Sep. 14, 2005, now abandoned.

(30) Foreign Application Priority Data

Mar. 18, 2005 (JP) ..... 2005-80323

(51) Int. Cl.
*B41J 2/155* (2006.01)

(52) U.S. Cl. ..... 347/42

(58) Field of Classification Search ..... None
See application file for complete search history.

(56) References Cited

U.S. PATENT DOCUMENTS

| | | | | |
|---|---|---|---|---|
| 4,994,825 | A | 2/1991 | Saito et al. | |
| 5,113,204 | A | 5/1992 | Miyazawa et al. | |
| 5,486,849 | A | 1/1996 | Miura et al. | |
| 6,460,965 | B2 | 10/2002 | Ikegami et al. | |
| 2003/0020787 | A1 | 1/2003 | Nakamura et al. | |
| 2004/0114985 | A1 * | 6/2004 | Ono et al. | 401/17 |
| 2005/0062800 | A1 | 3/2005 | Enomoto et al. | |
| 2005/0116995 | A1 | 6/2005 | Tanikawa et al. | |
| 2006/0042814 | A1 * | 3/2006 | Ball et al. | 174/65 G |
| 2006/0221116 | A1 | 10/2006 | Miyata | |

FOREIGN PATENT DOCUMENTS

| | | |
|---|---|---|
| JP | 2758060 | 5/1998 |
| JP | 2000-964 | 1/2000 |
| JP | 2000-263768 | 9/2000 |
| JP | 2000263768 A * | 9/2000 |
| JP | 2002-192724 | 7/2002 |

OTHER PUBLICATIONS

Translation of JP 2002-192724 A.*
Translation of JP 2000-263768 A.*

* cited by examiner

*Primary Examiner* — Matthew Luu
*Assistant Examiner* — Justin Seo
(74) *Attorney, Agent, or Firm* — Fildes & Outland, P.C.

(57) ABSTRACT

In a liquid droplet discharge apparatus that prevents deterioration in the precision of ink droplet landing positions resulting from deformation of long members due to changes in the temperature environment, long members to which plural head units are attached are fixed at one end but slidably supported at the other end. The long members no longer bend because the other ends of the long members slide.

20 Claims, 7 Drawing Sheets

LIQUID DROPLET DISCHARGE APPARATUS

CROSS-REFERENCE TO RELATED APPLICATIONS

This application is a division of U.S. application Ser. No. 11/226,765 filed Sep. 14, 2005 now abandoned, which claims priority under 35 USC 119 from Japanese Patent Application No. 2005-080323, the disclosures of both are incorporated by reference herein.

BACKGROUND OF THE INVENTION

1. Field of the Invention

The present invention relates to a liquid droplet discharge apparatus.

2. Description of the Related Art

An inkjet recording apparatus has been proposed where plural inkjet recording head units are arranged and fixed in a paper width direction in order to conduct image recording at a higher speed. For example, Japanese Patent No. 2,758,060 and Japanese Patent Application Publication (JP-A) No. 2000-000964 disclose inkjet recording apparatus where ink discharge ports are disposed in correspondence to the entire width of the recording paper.

In order to arrange and fix the plural inkjet recording head units, long support members (called "long members" below) are used. Oftentimes the long members and the portion (e.g., a frame) of the apparatus body of the inkjet recording apparatus to which the long members are attached are configured by different materials, and oftentimes the coefficients of thermal expansion are also different. For this reason, for example, when the inkjet recording apparatus is used in a temperature environment that is different from the environment in which the inkjet recording apparatus was manufactured, the deformation amounts are different for these members, and sometimes deformation such as bending arises in the long members. Due to this deformation, the discharge direction of the ink droplets changes, the landing positions of the ink droplets on the paper are displaced, and the image quality deteriorates. There is also the drawback that when the nozzle surface approaches the paper, these members contact the paper.

Moreover, excessive stress arises in the frame when the long members are strongly fixed to the frame in order to prevent such deformation of the long members.

SUMMARY OF THE INVENTION

A liquid droplet discharge apparatus is desired which can prevent the deterioration in the precision of the liquid droplet landing positions resulting from deformation of the long members due to temperature environment changes.

The present invention provides a liquid droplet discharge apparatus including: at least one head unit that discharges liquid droplets from nozzles; and at least one long member to which the head unit is attached, wherein the long member is attached to an apparatus body of the liquid droplet discharge apparatus such that portions of the long member is slidable with respect to the apparatus body in a longitudinal direction of the long member.

Because portion of the long member is configured to be slidable in the longitudinal direction in this manner, deformation such as bending of the long member can be prevented even if there is a change in the temperature environment. Thus, deterioration in the precision of the liquid droplet landing position can be prevented because there is no change in the direction in which the liquid droplets are discharged from the ink droplet discharge head attached to the long member.

The long member may be directly attached to the apparatus body of the liquid droplet discharge apparatus, but the liquid droplet discharge apparatus can be configured to include a frame that configures the apparatus body, and the long member may be attached to this frame.

The length of the long member is not particularly limited, but the long member is at least of a length such that the head unit can be attached in the longitudinal direction of the long member and reliably supported. In terms of recording an image with a full width array, the long member may be of a length such that head units of a number in which image recording can be conducted across the entire width of the recording medium are attachable to the long member.

At least one head unit may be attached to the long member, and the head unit may be configured to be long. Of course, plural head units may also be attached to the long member to form a liquid droplet discharge head that is long overall.

DETAILED DESCRIPTION OF THE INVENTION

Figure 1:
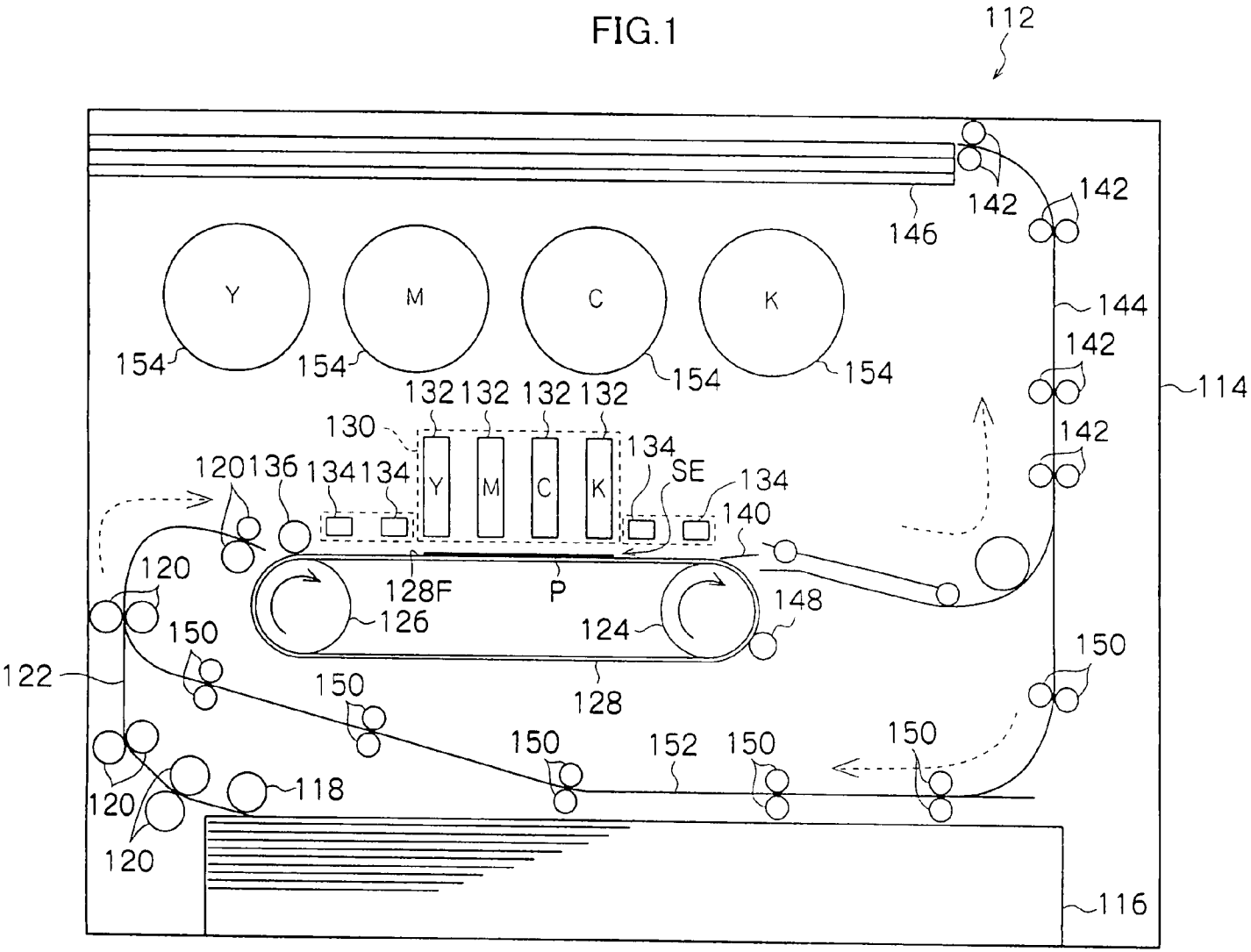
FIG. 1 is a schematic view showing the overall configuration of an inkjet recording apparatus of the invention.

FIG. 1 illustrates an inkjet recording apparatus 112 of a first embodiment of the invention. The inkjet recording apparatus 112 includes a casing 114 and a paper supply tray 116 disposed at a lower portion inside the casing 114. Sheets of paper P are stacked in the paper supply tray 116, and a pickup roll 118 removes the paper P one sheet at a time from the paper supply tray 116. The removed paper P is conveyed by plural conveyance roll pairs 120 that configure a predetermined conveyance path 122. Below, "conveyance direction" will be used to refer to the conveyance direction of the paper P, which is a recording medium, and "upstream" and "downstream" will be used to refer to directions upstream and downstream in the conveyance direction.

An endless conveyor belt 128 that is wound between a drive roll 124 and a driven roll 126 is disposed above the paper supply tray 116. A recording head array 130 is disposed above the conveyor belt 128 and faces a flat portion 128F of the conveyor belt 128. The region of the conveyor belt facing the recording head array 130 serves as a discharge region SE to which ink droplets are discharged from the recording head array 130. The paper P conveyed along the conveyance path 122 is retained by the conveyor belt 128 and reaches the discharge region SE, where ink droplets corresponding to image information are discharged onto the paper P from the recording head array 130 in a state where the paper P faces the recording head array 130.

Image recording resulting from multiple passes can be conducted by revolving the paper P in a state where it is retained by the conveyor belt 128 and causing the paper P to pass a plural number of times through the discharge region SE. Image recording may also be conducted in a single pass by causing the paper P to pass only one time through the discharge region SE.

In the present embodiment, the recording head array 130 comprises a full width array (FWA) whose effective recording region is equal to or greater than the width of the recording paper P (i.e., the length of the recording paper P in the directional orthogonal to the conveyance direction). The recording head array 130 includes four inkjet recording heads 132 that are disposed along the conveyance direction and correspond to the four colors of yellow (Y), magenta (M), cyan (C) and black (K), so that a full-color image can be recorded. The method by which the inkjet recording heads 132 discharge the ink droplets is not particularly limited; known formats can be used, such as the thermal format and the piezoelectric format.

The inkjet recording heads 132 are controlled by unillustrated recording head control means. The recording head control means determines the timing at which the ink droplets are to be discharged, and the ink discharge ports (nozzles) to be used, in accordance with the image information, and transmits drive signals to the inkjet recording heads 132.

The recording head array 130 may be configured to be immovable in the direction orthogonal to the conveyance direction, but when the recording head array 130 is configured to move as needed, a higher resolution image can be recorded by multiple pass image recording, and it can be ensured that problems in the inkjet recording heads 132 are not reflected in the recording result.

A charge roll 136, to which an unillustrated power supply is connected, is disposed upstream of the recording head array 130. The charge roll 136 follows the driven roll 126 as the conveyor belt 128 and the paper P are sandwiched between the charge roll 136 and the driven roll 126, and is configured to be movable between a pressing position, at which the charge roll 136 presses the paper P against the conveyor belt 128, and a separated position, at which the charge roll 136 is separated from the conveyor belt 128. In the pressing position, a predetermined electric potential difference arises between the charge roll 136 and the grounded driven roll 126, whereby an electric charge is imparted to the paper P to cause the paper P to be electrostatically sucked onto the conveyor belt 128.

The power supply may be a direct current power supply or an alternating current power supply as long as it can charge the paper P to a predetermined electric potential.

An unillustrated registration roll is disposed upstream of the charge roll 136 and aligns the paper P before the paper P is fed between the conveyor belt 128 and the charge roll 136.

A separation blade 140 is disposed downstream of the recording head array 130 and separates the paper P from the conveyor belt 128.

The separated paper P is conveyed by plural discharge roller pairs 142, which are disposed downstream of the separation blade 140 and configure a discharge path 144, and discharged to a discharge tray 146 disposed in an upper portion of the casing 114.

A cleaning roll 148 that can nip the conveyor belt 128 between itself and the drive roll 124 is disposed below the separation blade 140 and configured to clean the surface of the conveyor belt 128.

An inversion path 152 that is configured by plural inversion-use roller pairs 150 is disposed between the paper supply tray 116 and the conveyor belt 128. Image recording on both sides of the paper P can be easily conducted by inverting the paper P on which an image has been recorded on one side, and retaining the paper on the conveyor belt 128.

Ink tanks 154 that store inks of the four colors are disposed between the conveyor belt 128 and the paper discharge tray 146. The inks in the ink tanks 154 are supplied to the recording head array 130 by unillustrated ink supply tubes. Known types of inks can be used for the inks, such as water-based ink, oil-based ink, and solvent ink.

Figure 2:
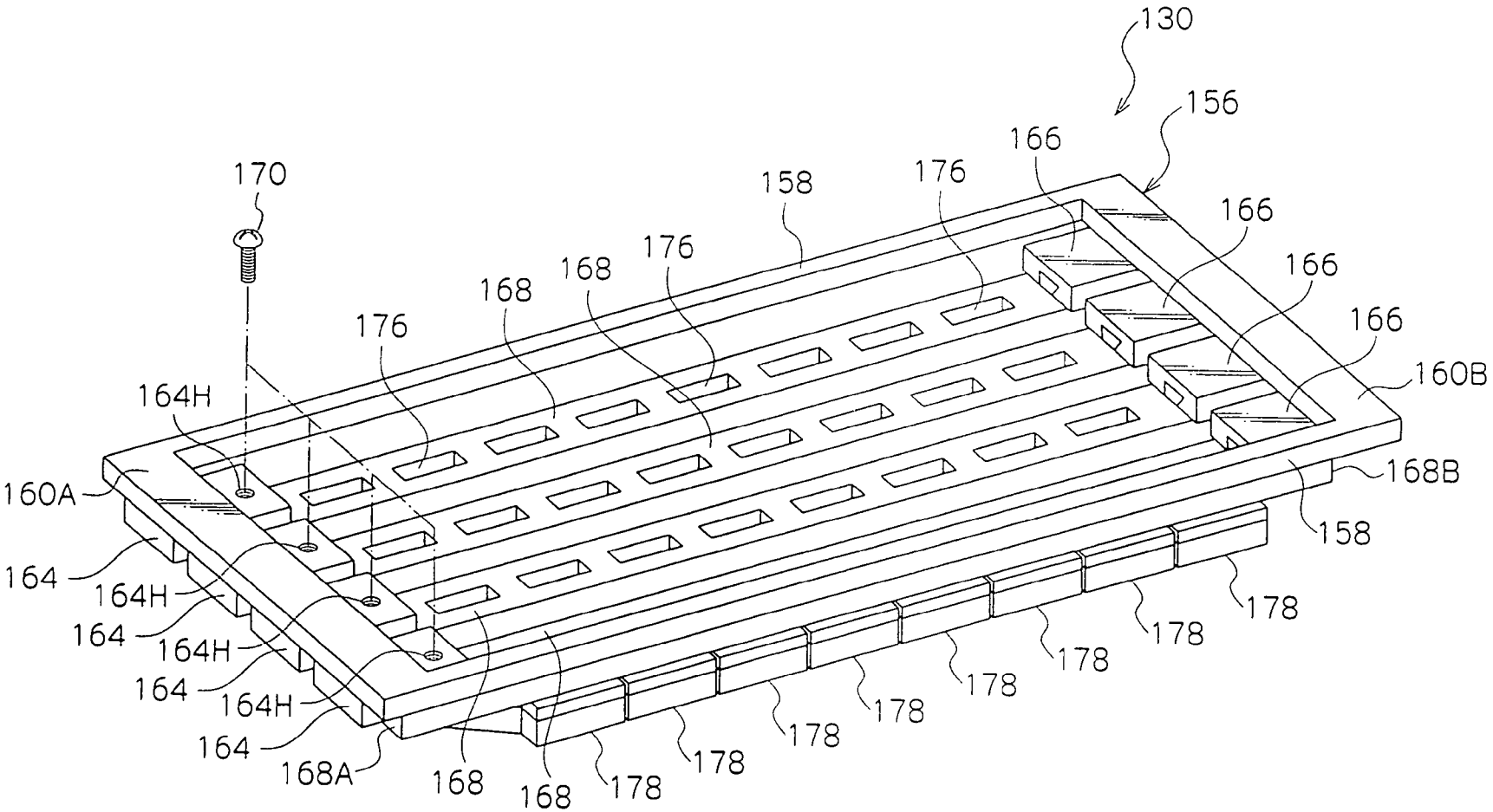
FIG. 2 is a perspective view partially showing an inkjet recording head array of an inkjet recording apparatus of a first embodiment of the invention.

As shown in FIG. 2, each recording head array 130 includes a long frame 156. The frame 156 is disposed facing the flat portion 128F of the conveyor belt 128 and at an orientation such that the longitudinal direction of long edges 158 of the frame 156 coincides with the direction orthogonal to the conveyance direction of the paper P.

Plural block-like fixed support members 164 are attached to one short edge 160A of the frame 156, and block-like slide support members 166 are attached to the other short edge 160B. The slide support members 166 are disposed in the same number as the number of fixed support members 164. Long members 168 are disposed at the undersurface side of, and between, the fixed support members 164 and the slide support members 166. The long members 168 are disposed in the same number as the number of fixed support members 164. The long members 168 are disposed at constant intervals in the paper feeding direction.

Screw holes 164H are formed in the fixed support members 164. The long members 168 are fixed to the fixed support members 164 at ends 168A of the long members 168 by screwing screws 170 into the ends 168A.

Figure 3A:
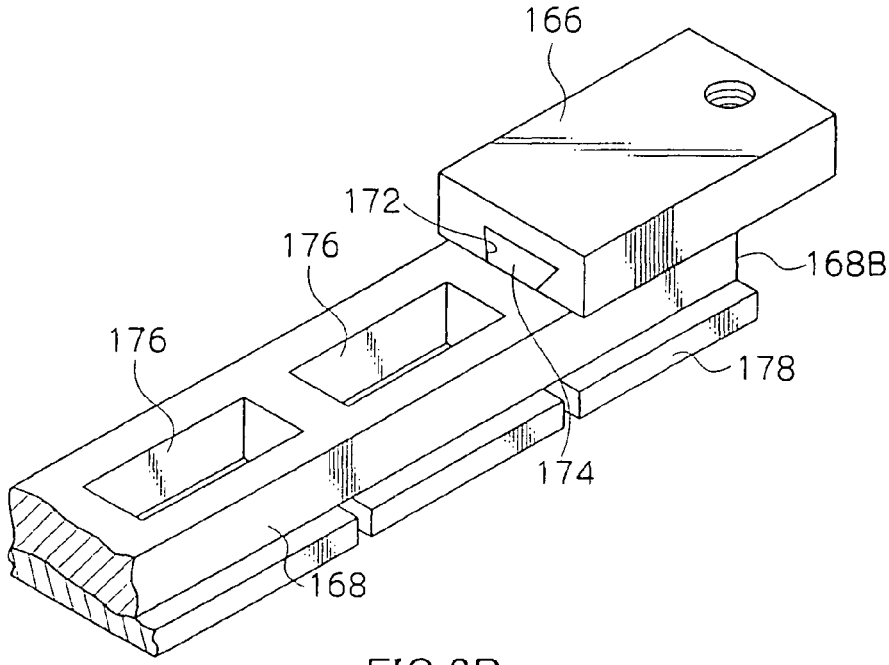
FIG. 3A is a partially enlarged perspective view of the inkjet recording head of the inkjet recording apparatus of the first embodiment of the invention.
Figure 3B:
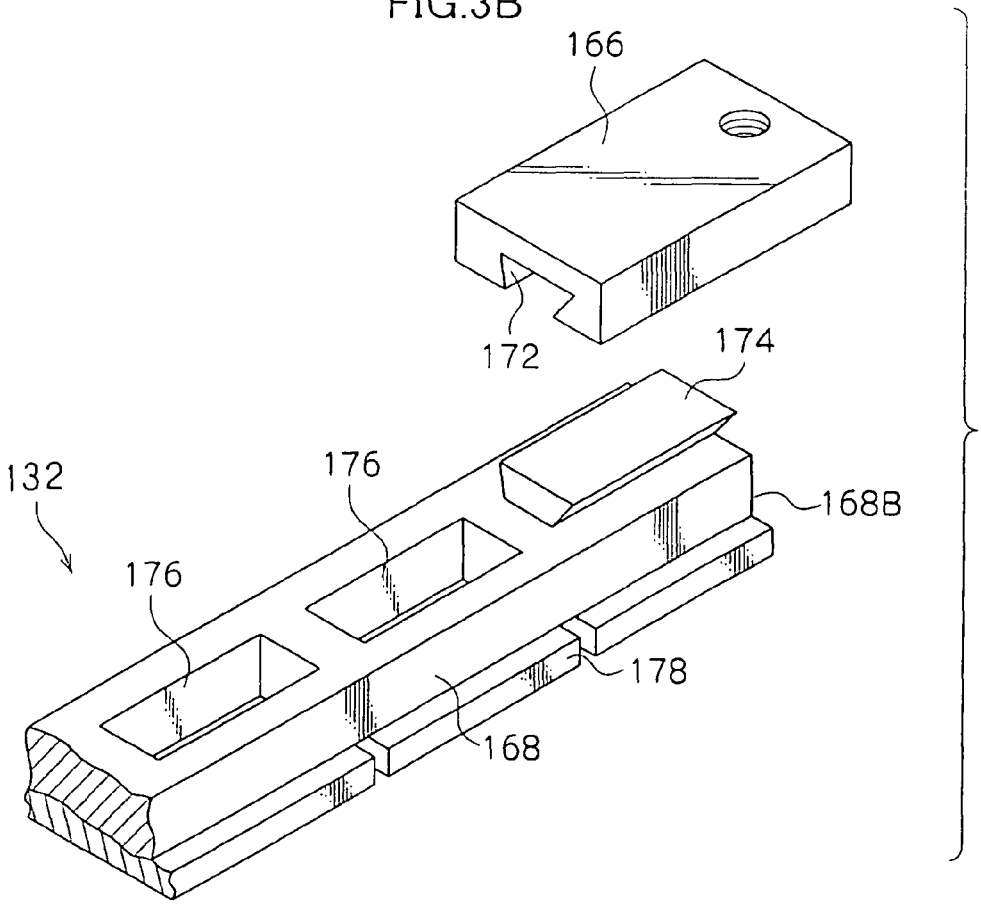
FIG. 3B is partially enlarged exploded perspective view of the inkjet recording head of the inkjet recording apparatus of the first embodiment of the invention.
Figure 4:
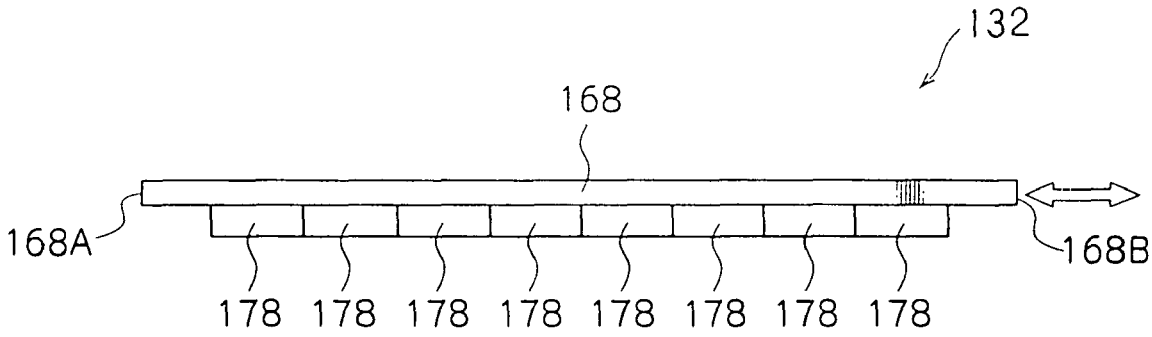
FIG. 4 is a conceptual view partially showing the inkjet recording head of the inkjet recording apparatus of the first embodiment of the invention.

As shown in greater detail in FIGS. 3A and 3B, a groove portion 172 is formed, along the longitudinal direction of the long members 168, in the undersurface of each slide support member 166. A protruding ridge 174 that engages with the groove portion 172 is formed in the upper surface of the other end 168B of each long member 168. Thus, as conceptually shown in FIG. 4, in the inkjet recording head 132 of the present embodiment, when the protruding ridge 174 is accommodated in and engaged with the groove portion 172, the protruding ridge 174 becomes unable to inadvertently escape from the groove portion 172, but the other end 168B of the long member 168 becomes slidable along the longitudinal direction.

Plural head attachment portions 176 are formed along the longitudinal direction in the long member 168. Head units 178 are attached to these head attachment portions 176. Thus, even though the head units 178 do not individually have a width equal to or greater than the width of the paper P, an image recording region equal to or greater than the width of the paper P can be obtained by arranging the plural head units 178 in the paper width direction. Namely, an image can be recorded on the entire surface of the paper P by moving only the paper P and without having to move the inkjet recording heads 132 along the width direction of the paper P. Thus, high productivity can be obtained.

In the inkjet recording apparatus 112 of the present embodiment configured in this manner, the paper P is removed from the paper supply tray 116, conveyed, and reaches the conveyor belt 128, as described above. Then, the paper P is pressed against the conveyor belt 128 by the charge roll 136, and is sucked (tightly contacts) and retained on the conveyor belt 128 by the applied pressure from the charge roll 136. In this state, the paper P passes through the discharge region SE due to the circulation of the conveyor belt 128, ink droplets are discharged onto the paper P from the recording head array 130, and an image is recorded on the paper P. When image recording is conducted in only a single pass, the paper P is separated from the conveyor belt 128 by the separation blade 140, conveyed by the discharge roller pairs 142, and discharged to the paper discharge tray 146. When image recording is conducted in multiple passes, the paper P is circulated, passed through the discharge region SE, separated from the conveyor belt 128 by the separation blade 140, conveyed by the discharge roller pairs 142, and discharged onto the paper discharge tray 146 until the necessary number of times is reached.

Here, in the inkjet recording head array 130 of the present embodiment, the long members 168 and the frame 156 are configured by preferable materials in consideration of the physical properties required of each and the cost. For this reason, when the inkjet recording apparatus 112 is used in a temperature environment that is different from the environment in which the inkjet recording apparatus 112 was manufactured, the long members 168 and the frame 156 exhibit different deformations due to the difference in their coefficients of thermal expansion. For example, when the frame 156 has a smaller coefficient of thermal expansion than that of the long members 168, the long members 168 bend in a configuration where both ends of the long members 168 are strongly fixed to the frame 156, whereby the positions at which the ink droplets discharged from the head units 178 land on the paper P also change.

Figure 5A:
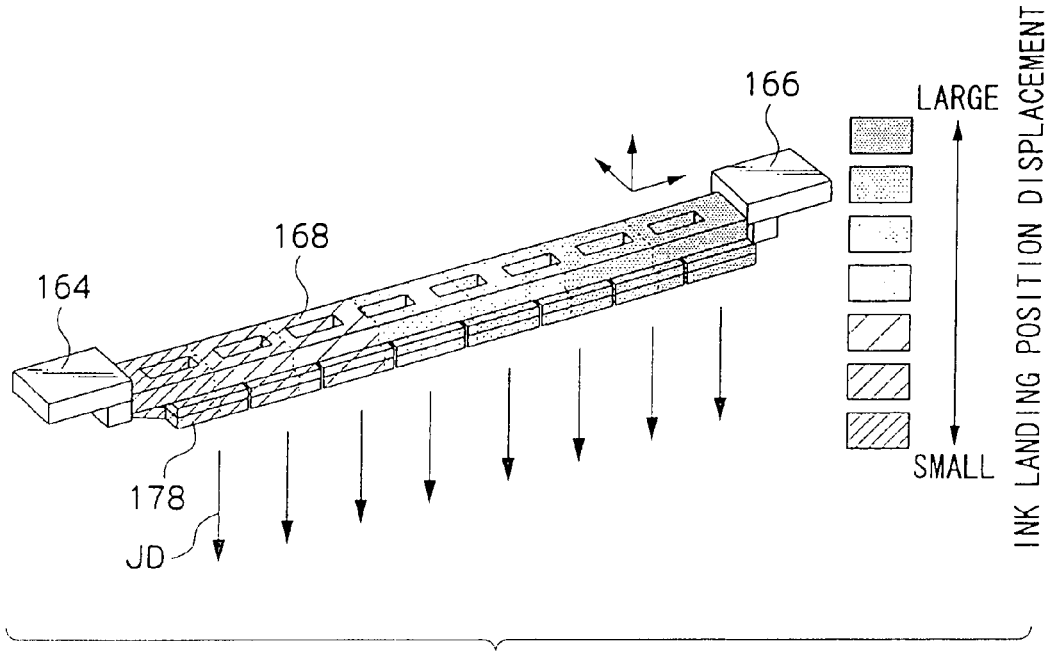
FIG. 5A is a descriptive view conceptually showing the discharge direction of ink droplets and the shape of a long member in a temperature environment that is different from the environment at the time of manufacture in the case of the first embodiment of the invention.
Figure 5B:
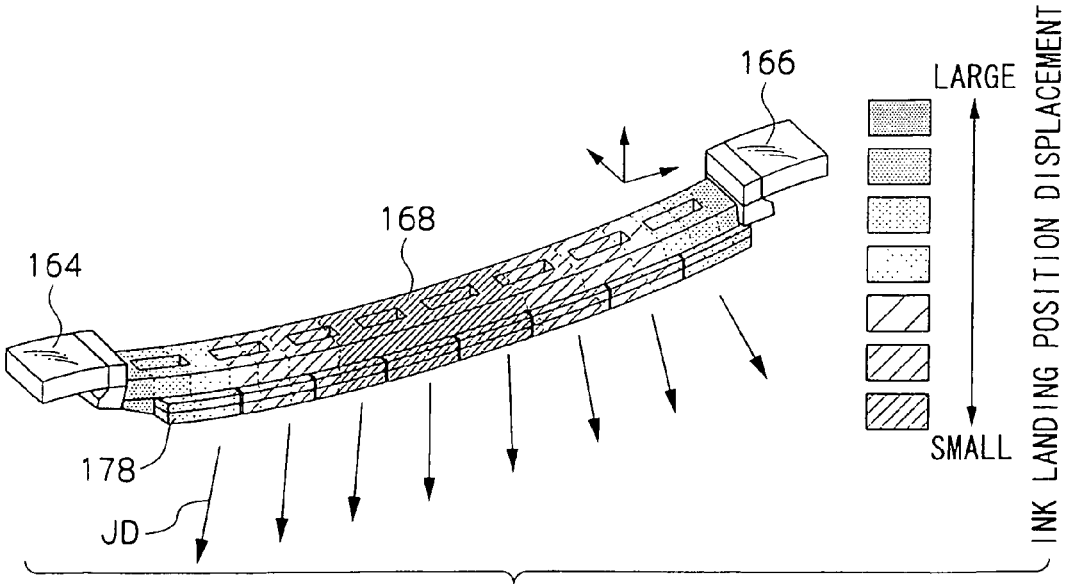
FIG. 5B is a descriptive view conceptually showing the discharge direction of ink droplets and the shape of the long member in a temperature environment that is different from the environment at the time of manufacture in the case of a comparative example.

As an example, FIG. 5B schematically shows deformation of the long member 168 (where the center portion sinks downward in a direction approaching the paper P) and changes in the discharge direction of the ink droplets (landing position displacement) in a case where the frame 156 has a smaller coefficient of thermal expansion than that of the long member 168, and where the rigidity of the head units 178 is sufficiently lower in comparison to that of the long member 168, and where the use environment of the inkjet recording head is hotter than the environment in which the inkjet recording head was manufactured.

Because the head units 178 in the vicinity of the center of the long member 168 simply move downward, the displacement in the landing positions of the ink droplets here is small, but towards both ends of the long member 168, the landing positions of the ink droplets are displaced in the paper width direction, as can be understood from the fact that the arrow JD representing the discharge direction of the ink droplets is slanted. Because the landing positions of the ink droplets are displaced in this manner between the center portion and the end portions in the width direction of the paper P, the quality of the image recorded on the paper P deteriorates.

There is the potential for the landing positions of the ink droplets to be displaced not only in the paper width direction but also in the paper feeding direction. In this case, the image quality further deteriorates.

Additionally, at the center portion of the long member 168, the head units 178 approach the paper P and the distance TD between the nozzle surface and the paper P changes. Thus, sometimes drawbacks arise, such as the paper P contacting the nozzle surface.

In contrast, in the present embodiment, the long members 168 are configured to be fixed only at the ends 168A and slidable in the longitudinal direction at the other ends 168B. For this reason, even if the expansion amounts are different between the long members 168 and the frame 156, the other ends 168B of the long members 168 slide, the difference in the expansion amounts is absorbed, and the long members 168 no longer bend.

FIG. 5A illustrates the change in the discharge direction of the ink droplets (landing position displacement) in the case where the other end 168B of the long member 168 slides in the present embodiment.

In the present embodiment, because the other end 168B of the long member 168 slides, the discharge direction of the ink droplets becomes constant regardless of the position on the long member 168, as can be understood from the arrow JD. The landing positions of the ink droplets spread slightly in the paper width direction overall due to the sliding of the long member 168, but high image quality can be preserved because the spreading is even.

Also, because the long member 168 does not bend, the landing positions of the ink droplets are not displaced in the paper feeding direction. In this respect also, a high-quality image can be recorded.

Additionally, because the long member 168 does not bend, there is no change in the distance between the nozzle surface and the paper P, and drawbacks such as the paper P contacting the nozzle surface do not arise.

Figure 6:
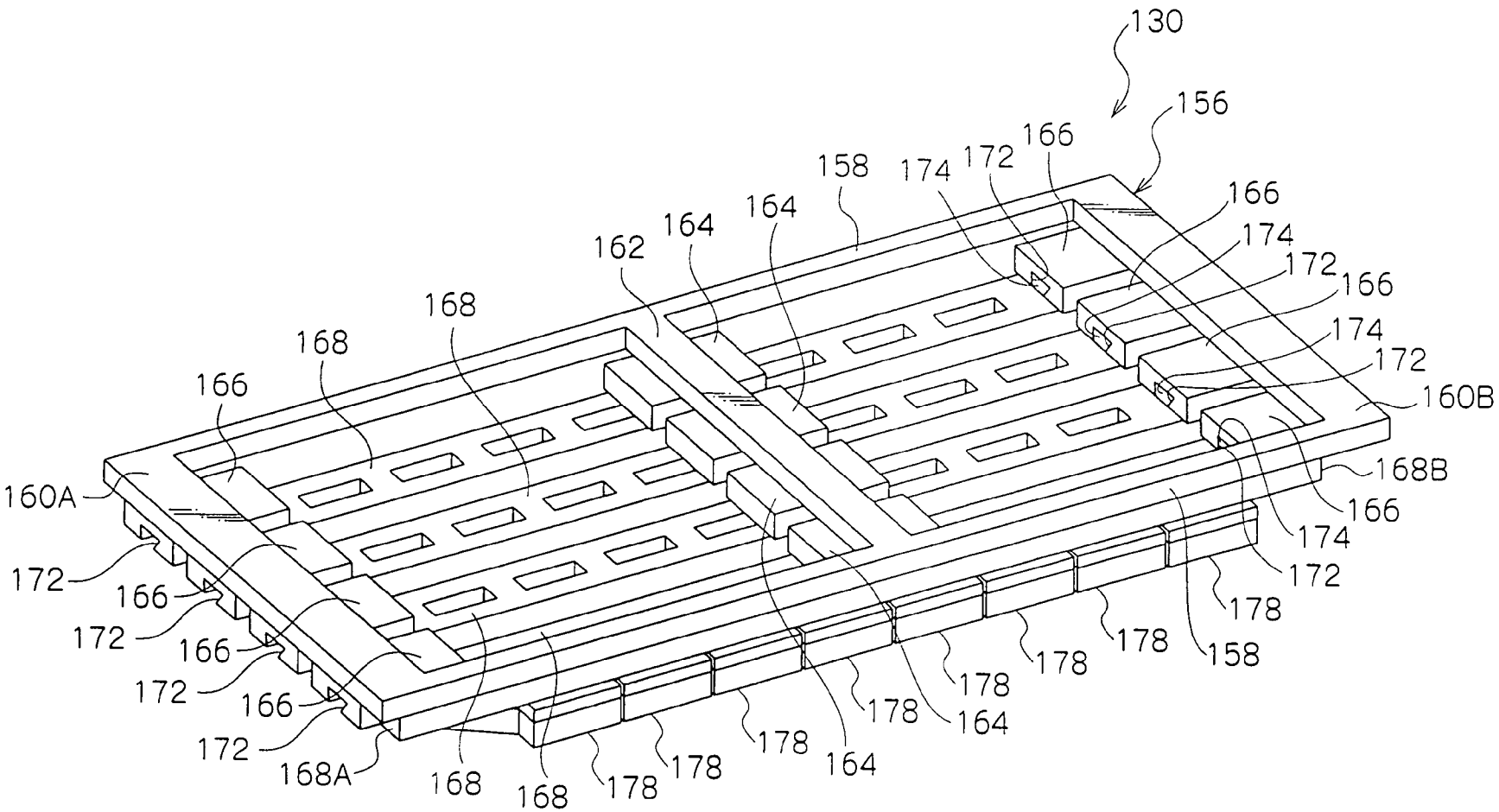
FIG. 6 is a perspective view partially showing an inkjet recording head array of an inkjet recording apparatus of a second embodiment of the invention.
Figure 7:
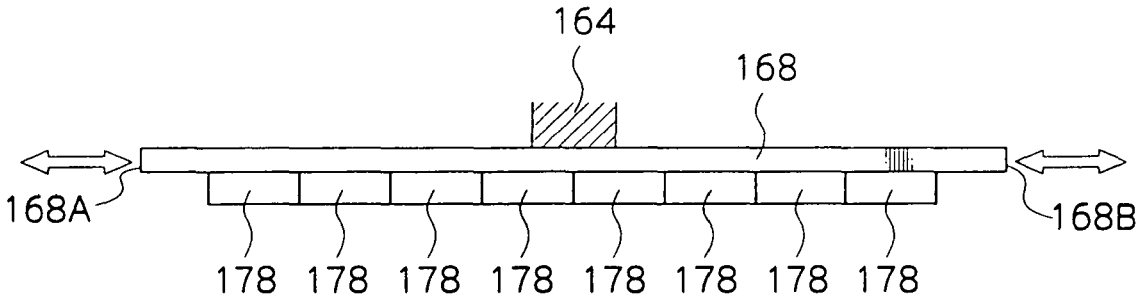
FIG. 7 is a conceptual view partially showing the inkjet recording head of the inkjet recording apparatus of the second embodiment of the invention.

FIG. 6 partially illustrates an recording head array 130 of a second embodiment of the invention.

In the recording head array 130 of the second embodiment, a support brace 162 is disposed across the longitudinal-direction center of the frame 156. Block-like fixed support members 164 are attached to the support brace 162, and screws 170 are inserted into screw holes 164H in the fixed support members 164 (the screws 170 and the screw holes 164H are not shown in FIG. 6; see FIG. 2) and screwed into the long members 168, whereby the long members 168 are fixed at their center portions to the fixed support members 164.

Also, in the second embodiment, block-like slide support members 166 are attached to the short edges 160A and 160B of the frame 156. Protruding ridges 174 formed at both ends of the long members 168 are accommodated in and engaged with groove portions 172 in the slide support members 166, so that both ends of the long members 168 are slidable along the longitudinal direction.

The remaining configuration is the same as that of the first embodiment.

In the second embodiment configured in this manner, similar to the first embodiment, the long members 168 do not bend even if the recording head array 130 is used in a temperature environment that is different from the environment in which the recording head array 130 was manufactured. Thus, the discharge direction of the ink droplets becomes constant, and high image quality can be preserved.

Also, because the long members 168 do not bend, the landing positions of the ink droplets are not displaced in the paper feeding direction. In this respect also, a high-quality image can be recorded.

Additionally, because the long members 168 do not bend, there is no change at all in the distance TD between the nozzle surface and the paper P, and drawbacks such as the paper P contacting the nozzle surface do not arise.

Particularly in the second embodiment, in comparison to the first embodiment, the displacement amount in the longitudinal direction of both end portions of the long members 168 becomes smaller than the displacement amount of the other ends 168B of the long members 168 in the first embodiment. For this reason, the displacement in the landing positions of the ink droplets in the paper width direction also becomes smaller than that in the first embodiment, and a high-quality image can be recorded. For example, in a configuration where inkjet recording heads 132 corresponding to different colors are arranged in the paper feeding direction, color displacement arises when the displacement amount in the paper width direction is different per ink droplet for each of the colors, but in the second embodiment, the color displacement becomes smaller because the displacement amount in the paper width direction per color is small. Namely, in the second embodiment, this is particularly preferable when conducting image recording with plural colors such as full color.

In the second embodiment, it is not necessary for the position at which the long members 168 are fixed by the fixed support members 164 to strictly be the longitudinal-direction center of the long members 168. Namely, the displacement in the landing positions of the ink droplets at both ends can be made smaller than that in the first embodiment if the position is further toward the center than the other ends 168B, even if the position is slightly offset from the center. Of course, it is particularly preferable for the position to be at the center because the landing position displacement can be reduced to a minimum. However, there are also times when the work for attaching the long members 168 to the fixed support members 164 becomes more difficult as the position becomes further toward the center. Thus, the long members 168 may be fixed at preferable positions in consideration of the displacement amount of the landing positions of the ink droplets and the ease of attachment.

In the above description, an example was described where the long members 168 were attached to the apparatus body of the inkjet recording apparatus via the frame 156, the fixed support members 164 and the slide support members 166, but the frame 156 may be omitted and the fixed support members 164 and the slide support members 166 may be attached directly to the apparatus body. However, from the standpoint of the ease of attachment, it is preferable when the frame 156 is intervened for the long members 168 to be attached to the frame 156 and then for these to be integrally attached to the apparatus body.

The long members 168 may also be directly attached to the frame 156 without intervening the fixed support members 164 and the slide support members 166. However, in this case, sometimes the molding and manufacture of the frame 156 becomes difficult because it becomes necessary to form the groove portions 172 in the frame 156, for example. Thus, it is preferable to intervene the fixed support members 164 and the slide support members 166 between the frame 156 and the long members 168.

In the preceding embodiments, an example was described where, as the liquid droplet discharge apparatus of the invention, an inkjet recording apparatus was disposed with inkjet recording heads that discharge ink droplets of the respective colors of black, yellow, magenta and cyan. However, the liquid droplet discharge apparatus of the invention are not limited to recording an image (including characters) on the recording paper P. Namely, the recording medium is not limited to paper, and the liquid that is discharged is not limited to ink. For example, common liquid droplet discharge apparatus used for industrial purposes are included, such as concomitantly using ink processing liquid, discharging ink onto polymer film or glass to make color filters for displays, and discharging molten solder onto a substrate to form bumps for mounting parts.

Also, in these liquid droplet discharge apparatus, the recording head array is not limited to a full width array. The invention may also be applied to a partial width array (PWA) including a main scanning mechanism and a sub-scanning mechanism. Moreover, the image recording may also be conducted in a single pass and not multiple passes.

In the present invention, the liquid droplet discharge apparatus may be configured to include at least one fixed member that is disposed on the frame and the fix portion of the long member, and at least one slide support member that is disposed on the frame and slidably support portions of the long member. In this configuration, the manufacturing becomes easy because it becomes unnecessary to dispose a structure for the fixing portion of the long member to the casing or a structure for slidably supporting portions of the long member to the casing.

In the present invention, the fixed member may be configured to fix ends at one side of the long member, and the slide support member may be configured to slidably support the other end of the long member.

In this manner, curving and constriction of the long member can be prevented with a simple configuration where end at one side of the long member is fixed and the other end of the long member is slidable.

In the present invention, the fixing member may be configured to at least one fix center portion of the long member, and the slide support member may be configured to slidably support both end portions of the long member.

In this configuration, the sliding amount of both end portions becomes smaller in comparison to the sliding amount of the other ends in the configuration where ends at one side of the long member is fixed and the other end of the long member is slidable. Thus, displacement in the landing positions of the ink droplets can be further reduced.

Because the invention is configured as described above, it can prevent deterioration in the precision of the ink droplet landing positions resulting from deformation of the long member due to changes in the temperature environment.

What is claimed is:

1. A liquid droplet discharge apparatus comprising:

a plurality of head units that discharge liquid droplets from nozzles;

a plurality of long members to which the head units are attached, the head units being positioned in a single row along each of the long members such that between two adjacent long members the head units are positioned collaterally;

a frame that forms an apparatus body of the liquid droplet discharge apparatus;

a portion of each said long member being fixedly attached to said frame and another portion of each said long member being slidably supported by said frame such that said slidably supported portion is slidable with respect to the apparatus body in a longitudinal direction of said long members;

at least one fixed support member disposed on said frame and fixedly attaching said long members to said frame; and at least one slide support member disposed on said frame and slidably supporting said long members in the longitudinal direction;

wherein said at least one fixed support member rigidly fixes said long members at a longitudinal-direction center of said long members such that said longitudinal-direction center of said long members does not move with respect to the frame, and each end portion of each long member is slidably supported by one said slide support member;

each of said at least one slide support member including a groove portion disposed along the longitudinal direction of said long members, and each of said long members including a protruding ridge that engages the groove portion of one slide support member;

the protruding ridge having a quadrilateral cross-sectional shape, and the cross-sectional shape of the groove portion corresponding to the cross-sectional shape of the protruding ridge.

2. A liquid droplet discharge apparatus comprising:

a frame;

at least one fixed support member attached to said frame;

at least one slide support member attached to said frame;

a plurality of long members each having first and second longitudinally opposite ends; and a plurality of head units that discharge liquid droplets from nozzles, said plurality of head units being attached to said long members, the head units being positioned in a single row along each of the long members such that between two adjacent long members the head units are positioned collaterally;

said long members being rigidly fixed to said at least one fixed support member at a longitudinal-direction center of said long members and slidably engaged with said at least one slide support member, wherein each end portion of each said long member is slidable relative to said frame in a longitudinal direction of said long members, and a portion of each said long member does not move with respect to said frame;

each of said at least one slide support member including a groove portion disposed along the longitudinal direction of said long members, and each of said long members including a protruding ridge that engages the groove portion of one slide support member;

the protruding ridge having a quadrilateral cross-sectional shape, and the cross-sectional shape of the groove portion corresponding to the cross-sectional shape of the protruding ridge.

3. The liquid droplet discharge apparatus of claim 2, wherein said frame has long edges disposed in a direction orthogonal to a conveyance direction of recording medium through said apparatus, and first and second short edges that are orthogonal to said long edges.

4. The liquid droplet discharge apparatus of claim 3, wherein said at least one fixed support member is attached to said first short edge of said frame, said at least one slide support member is attached to said second short edge, and each long member first end being fixed to one fixed support member and each long member second end being slidably engaged with one slide support member.

5. The liquid droplet discharge apparatus of claim 3, wherein said at least one fixed support member is attached to said frame intermediate said first and second short edges of said frame, said at least one slide support member is attached to one of said first and second short edges, and each long member is fixed to one fixed support member intermediate first and second ends of said long member and slidably engaged with one slide support member at one of the first and second ends of said long member.

6. The liquid droplet discharge apparatus of claim 5, including at least one slide support member attached to said first short edge of said frame and at least one slide support member attached to said second short edge of said frame, wherein each long member is slidably engaged with one slide support member at its first end and slidably engaged with one slide support member at its second end.

7. The liquid droplet discharge apparatus of claim 5, wherein said at least one fixed support member is attached to said frame at a longitudinal-direction center of said frame.

8. The liquid droplet discharge apparatus of claim 5, wherein said frame includes a support brace disposed across a longitudinal direction of said frame intermediate said first and second short edges, and said at least one fixed support member is attached to said support brace.

9. The liquid droplet discharge apparatus of claim 2, wherein the number of long members equals the number of fixed support members.

10. The liquid droplet discharge apparatus of claim 1, wherein the width of the protruding ridge increases in a direction away from the long member.

11. The liquid droplet discharge apparatus of claim 2, wherein the width of the protruding ridge increases in a direction away from the long member.

12. The liquid droplet discharge apparatus of claim 1, wherein an upper edge of the quadrilateral cross-sectional shape is longer than a lower edge of the quadrilateral cross-sectional shape.

13. The liquid droplet discharge apparatus of claim 2, wherein an upper edge of the quadrilateral cross-sectional shape is longer than a lower edge of the quadrilateral cross-sectional shape.

14. The liquid droplet discharge apparatus of claim 1, wherein the long member and the frame have different coefficients of thermal expansion.

15. The liquid droplet discharge apparatus of claim 2, wherein the long member and the frame have different coefficients of thermal expansion.

16. A liquid droplet discharge apparatus comprising:

a plurality of head units that discharge liquid droplets from nozzles;

a plurality of long members to which the head units are attached, the head units being positioned in a single row along each of the long members such that between two adjacent long members the head units are positioned collaterally;

a frame that configures an apparatus body of the liquid droplet discharge apparatus, said long members being attached to the frame such that portion of the long members are slidable with respect to the frame in a longitudinal direction of said long members;

at least one fixing member that is disposed on the frame and fixes a portion of the long members, and at least one slide support member that is disposed on the frame and slidably supports a portion of said long members;

wherein said at least one fixing member rigidly fixes the long members at a longitudinal-direction center of said long members such that said longitudinal-direction center of said long members does not move with respect to the frame, and each end portion of each long member is slidably supported by one said slide support member;

each of said at least one slide support member including a groove portion disposed along the longitudinal direction of said long members, and each of said long members including a protruding ridge that engages the groove portion of one slide support member;

the protruding ridge having a quadrilateral cross-sectional shape, and the cross-sectional shape of the groove portion corresponding to the cross-sectional shape of the protruding ridge.

17. The liquid droplet discharge apparatus of claim 16, wherein said at least one fixing member fixes the long members from above the long members.

18. The liquid droplet discharge apparatus of claim 16, wherein the width of the protruding ridge increases in a direction away from the long member.

19. The liquid droplet discharge apparatus of claim 16, wherein an upper edge of the quadrilateral cross-sectional shape is longer than a lower edge of the quadrilateral cross-sectional shape.

20. The liquid droplet discharge apparatus of claim 16, wherein the long member and the frame have different coefficients of thermal expansion.

* * * * *